United States Patent [19]

Kurushima et al.

[11] Patent Number: 4,481,765

[45] Date of Patent: Nov. 13, 1984

[54] SLIVER GUIDE FOR USE IN OPEN-END SPINNING FRAMES

[75] Inventors: Tadanori Kurushima, Kariya; Yoshiaki Yoshida, Toyota; Kazuo Kamiya, Nishio, all of Japan

[73] Assignee: Kabushiki Kaisha Toyoda Jidoshokki Seisakusho, Kariya, Japan

[21] Appl. No.: 482,055

[22] Filed: Apr. 5, 1983

[30] Foreign Application Priority Data

Apr. 7, 1982 [JP] Japan ..... 57-49424[U]

[51] Int. Cl.[3] ..... D01H 7/892

[52] U.S. Cl. ..... 57/412; 57/352

[58] Field of Search ..... 57/408–413, 57/352, 90

[56] References Cited

U.S. PATENT DOCUMENTS

| | | | |
|---|---|---|---|
| 3,950,929 | 4/1976 | Morikawa et al. | 57/412 |
| 4,096,686 | 6/1978 | Stahlecker et al. | 57/412 |
| 4,379,386 | 4/1983 | Goldammer et al. | 57/405 |

*Primary Examiner*—John Petrakes

*Attorney, Agent, or Firm*—Brooks, Haidt Haffner & Delahunty

[57] ABSTRACT

A sliver guide has a restrictor and deflectors for imposing uniform transverse forces on a sliver immediately before the latter is supplied to a feed roller in an open-end spinning unit, thereby spreading the sliver and loosening the core thereof. The sliver guide serves to prevent grain variations and neps that are otherwise caused in the spun yarn by the hard core and twists of the sliver which naturally form as the latter is being produced.

7 Claims, 5 Drawing Figures

SLIVER GUIDE FOR USE IN OPEN-END SPINNING FRAMES

BACKGROUND OF THE INVENTION

The present invention relates to a sliver guide for use in an open-end spinning frame, and more particularly to a sliver guide for guiding a sliver to a collector in a spinning frame.

Ordinarily, a sliver as supplied to an open-end spinning frame is reduced in diameter by a gatherer and then a trumpet in a drawing frame, and thereafter is forcibly pressed by a calendar roller and coiled in a can by a coiler. The sliver thus treated has a hard central core twisted by being coiled. When such sliver is supplied directly from the can to a spinning unit in the open-end spinning frame, the sliver is twisted and the fibers are loosened, resulting in the difficulty that the sliver is not uniformly gripped and fed along to be properly opened. More specifically, the fibers in the hard core of the sliver are relatively easily pulled by a feed unit, while fibers around the core tend to be delayed. As a result, portions of the sliver may loosen within the collector, whereupon it may not be uniformly gripped, fed along, and opened. Spun yarn formed by such sliver is likely to have thin and thick portions, and to have grain variations and neps.

SUMMARY OF THE INVENTION

It is an object of the present invention to provide a sliver guide for open-end spinning frames which is designed to prevent or reduce the number of such grain variations and neps which result from the non-uniform core and twists in the sliver while it is being produced.

According to the present invention, there is provided a sliver guide shaped to provide restrictions in its path for imposing a uniform transverse force on the sliver, immediately before the latter is supplied to a feed roller, thereby spreading the sliver and loosening the core thereof.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIC. 4 is an enlarged perspective view of only the sliver guide illustrated in FIG. 3.

DESCRIPTION OF THE PREFERRED EMBODIMENTS

Figure 1:
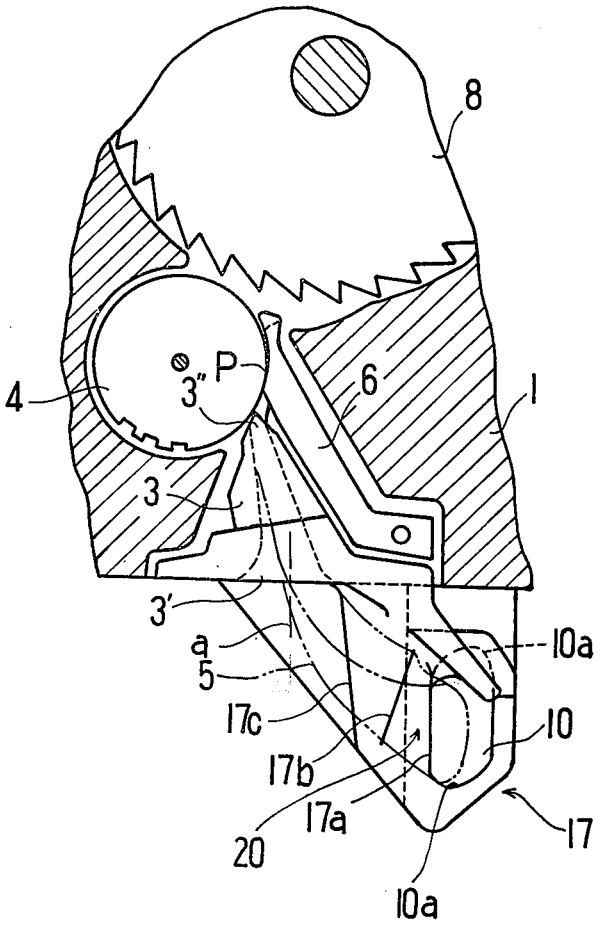
FIG. 1 is a fragmentary plan view of a sliver guide according to an embodiment of the present invention, attached to a spinning unit which is illustrated in cross-section.
Figure 3:
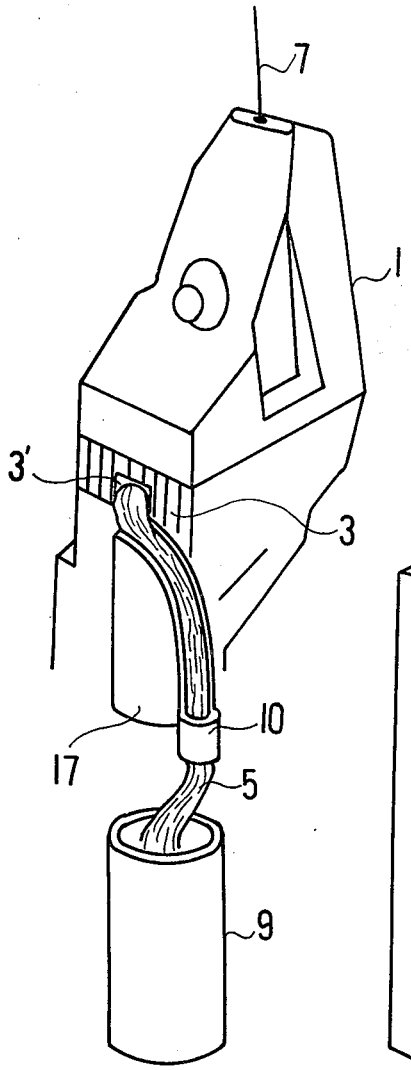
FIG. 3 is a perspective view of a channel-shaped silver guide according to another embodiment of the present invention, attached to a spinning unit and showing sliver being pulled through the guide and into the unit from a sliver can.

As shown in FIG. 1, a rotor-type open-end spinning frame (not shown) has a spinning unit 1 associated with each spindle. The spinning unit 1 has a collector 3 for receiving a sliver 5 (shown in dotted lines) and a presser 6 for pressing the sliver 5, fed through the collector 3, against a feed roller 4 which supplies the sliver 5 to a combing roller 8. The combing roller 8 serves to comb the sliver 5 into individual fibers. The spinning unit 1 also includes a spinning rotor (not shown) for spinning fibers carried by an air flow through a supply channel from the combing roller 8. The spinning unit 1 thus operates to comb and spin the sliver 5 supplied from a sliver can 9 (FIG. 3) through the collector 3 for thereby forming a yarn 7 (FIG. 3).

A sliver guide 17 according to the present invention is positioned upstream of the spinning unit 1 in the direction of feed of the sliver, immediately in front of the collector 3. The collector 3 and sliver guide 17 constitute a sliver guide assembly in accordance with the invention. The sliver is stored in a compressed state in the sliver can 9, and is in a flattened condition when taken out of the sliver can 9. It is necessary to control the sliver just before it passes into the collector 3 in order that the sliver will be fed straight into the nip portion P (FIG. 1) between the feed roller 4 and the presser 6 while the sliver is being kept flattened. Furthermore, in order to allow the flat sliver to be pressed against the sliver guide restrictor portions provided by the present invention, under the pulling force from the feed roller, it is desirable that the sliver be supplied from a position displaced either to the left side or to the right side of the center of the inlet 3' of the collector 3, the direction of such displacement being determined by that of the nip P (FIG. 1) with respect to the collector outlet 3'', as will be explained.

Figure 2:
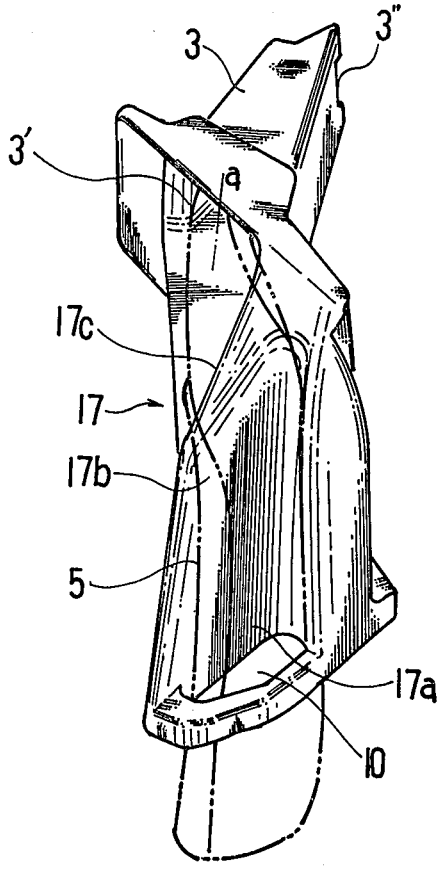
FIG. 2 is a perspective view of the sliver guide shown in FIG. 1, but showing only the collector element of the spinning unit.

According to the embodiment shown in FIGS. 1 and 2, a sliver guide 17 has a continuously helical guide surface for guiding the flat surface of the sliver 5 thereon. The guide surface of the sliver guide 17 is composed of an annular restrictor **17*a* which holds the sliver 5 as it enters the guide, and sliver deflectors 17*b*, and 17*c*, which are portions of the guide surface 20, for guiding the sliver 5 in a lateral direction, and thence in a front-to-back direction, respectively, so that the cross-sectional orientation of the sliver is displaced approximately 90° as it moves between the restrictor 17*a* and the inlet 3', as illustrated by the dotted line showings in FIGS. 1 and 2. The sliver 5 passes through the sliver insertion hole 10 which is formed by the annular restrictor 17*a*, and is pressed against the guide surface while it moves therealong. The sliver insertion hole 10 also serves to unravel and separate the length portions of the sliver 5 as it uncoils itself upon removal from the sliver can. Regarding the shape of the opening 10, if it were the same rectangular shape as the sliver 5 passing through it, it might tend to offer too much resistance to the sliver movement. Although any shaped opening which does not offer too much resistance would be acceptable, the opening 10 as shown is provided with angular-shaped end extension portions 10*a*** at its respective ends to permit the sliver to move more freely.

As the upwardly moving sliver is pulled along and against the sliver guide surface 20, the sliver 5 is first directed laterally by the lateral deflector **17*b*, towards the center a of the collector inlet 3'**, and then inwardly towards the collector inlet 3' by the front-to-back deflector 17c. While being thus guided, the sliver 5 is spread so that its core is loosened and softened, while any twist in the sliver 5 imparted thereto by its having been coiled in the can, is forced down toward the can 9. Accordingly, the sliver 5 is fed into the collector 3 under uniform conditions, and is compressed uniformly and nipped and fed along evenly therein. Spun yarn produced therefrom is of uniform quality, having only a few thick and thin portions and neps, and few grain variations. As shown in FIG. 2, the deflectors 17b, 17c are inclined downwardly as they extend away from the collector 3 to enable the sliver 5 to be pressed uniformly against the guide surface, particularly the deflectors 17b, 17c, throughout the width of the sliver 5. It is important that the deflector 17c be tilted downwardly in this manner in order to allow the sliver 5 to be held uniformly against it, since the upper and lower edges of the flattened sliver 5 are now widely spread in a vertical sense across the surface of the deflector 17c.

Figure 4:
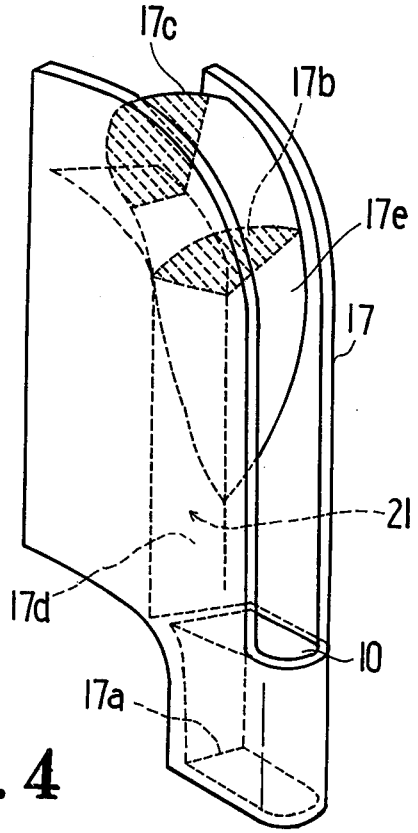

FIGS. 3 and 4 show a sliver guide 17 according to another embodiment of the present invention, the sliver guide 17 having an annular restrictor 17a through which the upwardly pulled sliver 5 enters the guide, and deflectors 17b, 17c, constituting portions of the guide surface 21, for guiding the sliver 5 in the desired deflected directions. The connecting sliver guide surface as it passes between the restrictor 17a and deflectors 17b, 17c is formed as a continuously helical surface which displaces the cross-sectional orientation of the sliver about 90° between the restrictor 17a and the inlet 3'. As shown, the sliver guide 17 is channel-shaped so that the sliver 5 can be treated with ease while moving therealong. That is, in FIG. 4 the bottom of the sliver guide is provided with a flat portion 17d between the side walls, and an outwardly bulged portion 17e on the downstream side thereof, on which the deflectors 17b, 17c are formed. The sectional shapes of the bulged portion at the respective locations of the deflectors 17c, 17d are shown in dotted line showings respectively therebelow. The restrictor 17a, and deflectors 17b, 17c in FIG. 4 functionally correspond respectively to the restrictor 17a, and deflectors 17b, 17c in FIG. 2. Therefore, in this embodiment, upon supplying the sliver from the can to the guide, the sliver is first unraveled and separated by the restrictor 17a; then passed along the said flat portion 17d (between the side walls) and onto the bulged portion 17e of the guide, changing its direction continuously as it moves upwardly. It is directed laterally by the deflector 17b, and then, by said deflector 17c, its direction is changed forwardly. As it moves slowly along such guide surface, the sliver is simultaneously spread in its width, under soft resistance, and straightened, the twist of the sliver being transmitted downwardly towards the can. Thus, the sliver is smoothly fed straight into the collector inlet 3'.

Figure 5:
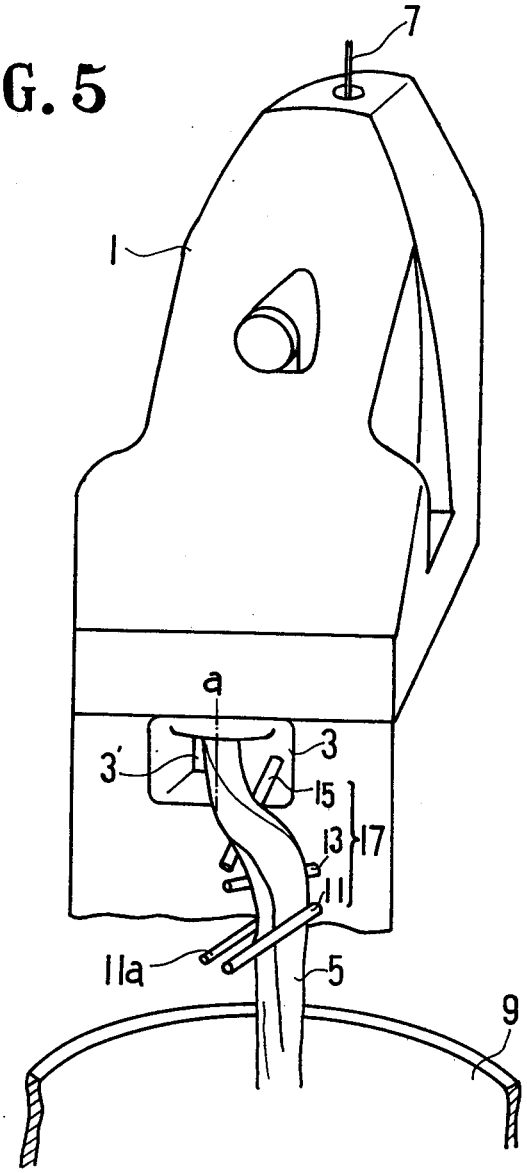
FIG. 5 is a fragmentary perspective view of a sliver guide according to still another embodiment of the invention, attached to a spinning unit and showing sliver being fed therethrough.

According to a still another embodiment illustrated in FIG. 5, the sliver guide 17 comprises three guide members 11, 13, 15 in the form of rods positioned to the right side (as shown) of an imaginary central vertical line a extending across the collector inlet 3', the guide rods being interposed between the can 9 and the collector 3. The rod guide members 11, 13, 15 correspond functionally to the restrictor 17a and the deflectors 17b, 17c, respectively, as illustrated in FIGS. 1 and 2. The rod guide member 11 is disposed in the lowermost position closest to the can 9 and, together with the adjacent laterally spaced parallel rod 11a, constrains the sliver 5 as it enters the guide. The rod guide member 13 is located downstream of the rod guide member 11 in the direction of feed of the sliver 5 from the can 9. The rod guide member 13 is angularly displaced in lateral direction about 45° with respect to the rod guide member 11, and the sliver 5 is sandwiched between the rod guide members 11, 13. The rod guide member 11 is positioned to the right of the central line a across the inlet 3' and, together with the rod 11a, serves as a restrictor for controlling the position and manner in which the sliver enters the sliver guide. The rod guide member 13 serves as a lateral deflector for guiding the sliver 5 towards the central position a of the collector inlet 3'. The rod guide member 15 is located above the central rod guide member 13 and is angularly displaced in lateral direction about 45° with respect to the latter. The rod guide member 15 serves as a front-to-back deflector for completing the same 90° of angular displacement of the sliver cross-section and allowing the sliver 5 to move straight through the collector from its inlet 3' to the collector outlet 3'' (FIG. 1). While the sliver 5 is moving across and being deflected by the rod guide members 11, 13, 15, it is pressed against them due to the combined forces of gravity and the pulling of the feed roller 4 acting on the sliver. Thus, any twist in the sliver 5 due to its having been coiled in the can is forced back down the sliver 5 towards the can 9, and the sliver 5 is free from unwanted twists as it goes through the rod guide members 11, 13, 15. The sliver 5 is first deflected laterally by the rod guide member 13 and then backward into the collector 3 by the rod guide member 15. The sliver 5 is therefore forcibly spread apart and its core loosened, whereupon it is supplied under uniform conditions to the collector 3 in which the sliver 5 is compressed. The sliver 5 thus treated can be uniformly nipped and fed along, and the resultant spun yarn is uniform in quality, suffering from few grain variations and neps. When the flattened sliver 5 is deflected, it has a tendency to be pressed against the deflectors under uneven transversely acting forces. However, such pressing forces can be made more uniform by tilting the deflectors, that is, the rod guide members 13, 15. In particular, the rod guide member 15 should be inclined downwardly, with its lower end more remote from the collector 3, to take up any sag which the sliver 5 may have along its upper edge as it is deflected towards the collector 3.

In accordance with the present invention, the same surface of the sliver 5 should always be pressed against the sliver guide 17 and the collector 3 as the sliver 5 is pulled from the can 9 by the feed roller 4. The nip P between the feed roller 4 and the presser 6 is displaced to the right, as shown in FIG. 1, of the collector outlet 3'', and hence the guide 17 should also be displaced to the right of the collector opening 3' as far as possible. If the nip P were displaced to the left of the collector outlet 3'' and the guide 17 were retained in its position to the right side, the sliver 5 in the collector 3 would have varied surfaces in contact with the collector surfaces, and would tend to be twisted and slackened. Accordingly, when the nip P is displaced to the left, the sliver guide 17 should also be displaced to the left side of the collector center a, and the collector 3 itself should be reversed to provide a left-to-right direction of infeed. Of course, the angular dispositions of the deflectors 17b, 17c (FIGS. 1, 2 and 4) and of the rods 13, 15 (FIG. 5) would also be reversed.

Further, in any embodiment the sliver guide may be formed integrally with the front face of the spinning unit, or with the collector as shown in FIG. 2, the latter being preferred. Regarding the embodiment of FIG. 5, the rods 11, 11*a*, 13 and 15 may be imbedded in the face of the spinning unit 1.

Comparative data obtained by using an open-end spinning frame with a sliver guide of the invention and an open-end spinning frame without such guide will be described below. The spinning conditions are as follows:

| | |
|---|---|
| Sliver: | Cotton 330 grains/6 yards |
| Fineness: | 4.5 micrograms/inch |
| Grade: | strict middling |
| Fiber length: | 17/16 inches |
| Spinning count: | Ne $7^s$ |
| Spinning motor rpm: | 60,000 rpm |
| Combing roller rpm: | 8,000 rpm |
| Twist multiplier: | 4.9 |

Spun yarns produced exhibited the following features:

| | Spinning frame of the invention | Prior spinning frame |
|---|---|---|
| u % (% Deviation from average yarn thickness) | 9.1 | 10.1 |
| Thin portions (/1000 m) | 0 | 0 |
| Thick portions (/1000 m) | 4 | 15 |
| Neps (11000 m) | 21 | 34 |
| Fluffs (0.5 mm) (/10 m) | 344 | 345 |

With the sliver guide of the invention, an open end spun yarn of improved appearance and uniformity can be produced, thick and thin yarn portions, grain variations and neps are reduced; and heavier spun yarn can be produced.

Although certain preferred embodiments have been shown and described, it should be understood that many changes and modifications may be made therein without departing from the scope of the appended claims.

What is claimed is:

1. A sliver guide assembly for use in an open-end spinning frame, comprising a sliver collector for receiving sliver as it travels therethrough and having an inlet having a central position and an outlet, and sliver guide means positioned upstream of said collector inlet with respect to the direction of travel of said sliver and spaced laterally away from said inlet central position, said sliver guide means including restrictor means for holding and controlling the position of said sliver as it enters said sliver guide means, lateral deflector means positioned downstream of said restrictor means in the direction of travel of said sliver and being angularly displaced with respect to said restrictor means for directing the sliver towards said central position on said sliver collector inlet, and front-to-back deflector means positioned downstream of said lateral deflector means substantially adjacent to said collector inlet and being angularly displaced with respect to said lateral deflector means for directing the sliver into said inlet and to said outlet of the sliver collector.

2. A sliver guide assembly according to claim 1, wherein said front-to-back deflector means is tilted downwardly in a direction extending away from said sliver collector inlet.

3. A sliver guide assembly according to claim 1, wherein said sliver guide means comprises a plurality of rod guide members each projecting in direction generally away from said sliver collecting inlet.

4. A sliver guide assembly according to claim 1, wherein said sliver guide means comprises a continuously curved helical sliver guide surface.

5. A sliver guide assembly according to claim 1, wherein said sliver guide comprises a continuously curved channel-shaped surface.

6. A sliver guide assembly according to claim 1, wherein said sliver guide restrictor means comprises means defining a sliver-receiving opening for the sliver as it enters said sliver guide means.

7. A sliver guide assembly according to claim 1, wherein said assembly is mounted on an open-end spinning unit containing a feed roller and a presser in engagement with each other to provide a nip therebetween for nipping sliver received from said sliver collector outlet, said nip being laterally displaced to one side of an imaginary line extending from the center of said outlet of the sliver collector to said central position of said inlet thereof, said sliver guide means being spaced laterally away from said inlet central position on said one side thereof.

* * * * *